US006530428B1

(12) United States Patent
Baird

(10) Patent No.: US 6,530,428 B1
(45) Date of Patent: Mar. 11, 2003

(54) METHOD AND APPARATUS FOR IN-SITU PRODUCTION WELL TESTING

(75) Inventor: Jeffery D. Baird, Breckenridge, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/937,054

(22) PCT Filed: Oct. 26, 2000

(86) PCT No.: PCT/US00/41593

§ 371 (c)(1),
(2), (4) Date: Sep. 19, 2001

(87) PCT Pub. No.: WO02/35054

PCT Pub. Date: May 2, 2002

(51) Int. Cl.[7] ..... E21B 33/127

(52) U.S. Cl. ..... 166/133; 166/187; 166/250.17; 166/142; 166/387; 166/188; 175/50; 175/230; 73/152.38; 73/152.19; 73/152.26

(58) Field of Search ..... 166/187, 250.01, 166/250.07, 250.17, 142, 387, 386, 133, 188; 177/50, 230; 73/152.38, 152.19, 152.23, 152.26

(56) References Cited

U.S. PATENT DOCUMENTS

| | | | | |
|---|---|---|---|---|
| 2,978,046 | A | | 4/1961 | True |
| 3,327,781 | A | | 6/1967 | Nutter |
| 3,850,240 | A | | 11/1974 | Conover |
| 4,083,401 | A | | 4/1978 | Rankin |
| 4,345,648 | A | | 8/1982 | Kuus |
| 4,424,860 | A | | 1/1984 | McGill |
| 5,799,733 | A | | 9/1998 | Ringgenberg et al. |
| 5,864,057 | A | * | 1/1999 | Baird |
| 6,092,416 | A | | 7/2000 | Halford et al. |
| 6,148,664 | A | * | 11/2000 | Baird |
| 6,343,650 | B1 | * | 2/2002 | Ringgenberg |

FOREIGN PATENT DOCUMENTS

| | | |
|---|---|---|
| WO | PCT/US98/22379 | 5/1999 |

* cited by examiner

*Primary Examiner*—Roger Schosppel
(74) *Attorney, Agent, or Firm*—Michael W. Piper

(57) ABSTRACT

An apparatus for in situ borehole testing having a drill string with drill pipe and drill bit. An upper sleeve and lower sleeve are telescopically coupled together. A valve seat is located in an interior passage and closes the interior passage when a valve member is seated in the valve seat. A plurality of separate inflatable packers are coupled to the lower sleeve and activated when the valve member is seated in the valve seat. A latching collet having teeth positively interlocks with spline teeth affixed to the inner wall of the upper sleeve. A hydraulic valve assembly is attached to the lower sleeve and is activated by fluid in one of a plurality of separate fluid chambers which communicate with and inflate the separate packers.

3 Claims, 14 Drawing Sheets

METHOD AND APPARATUS FOR IN-SITU PRODUCTION WELL TESTING

BACKGROUND OF THE INVENTION

The present invention relates to conducting production tests of wells penetrating earth formations, such as oil and gas wells. More particularly, the present invention provides an improved method and apparatus for testing wells without the need to withdraw the drill stem from the borehole.

International patent application number PCT/US98/22379 teaches and discloses methods and apparatuses for testing wells while leaving the drill stem in the borehole. This application is incorporated herein by reference for all purposes.

Significant advances have been made in the present invention to provide a system for shutting in the well so that tests can be made. Such improvements relate to the structural use of the activation mechanism for inflating downhole packers including an improved collet/spline configuration to more positively hold and release the packer mandrel; a simplified hydraulic fluid reservoir and feed system to the packers; the utilization of a plurality of packers having varying pressure capabilities; an improved packer attachment assembly; and an improved hydraulic float valve coordinated with the packer hydraulic system.

SUMMARY OF THE INVENTION

The testing drill collar of the present invention may be positioned between the drill bit and the drill collar assembly. The inflatable packer assembly may be dressed to accommodate environments that arise in different geological areas. This may be obtained by selecting a packer design of short element combination, short and long combination, or only one long element. Packer material and designs depend on area, depth, and bottom hole temperature.

The tool is locked in the drill position until deployed by an activating tool via slickline, electric line, or by pumping the activating tool down. Once activated, the lower portion of the drill collar scopes downward. The length of travel is controlled by the amount of pressure applied against the activating tool and consequentially the pressure is delivered to a piston which compresses clean compressible fluid from the reservoir into the packer elements. The packers have separate fluid reservoirs but inflate simultaneously. It should be understood that the fluid utilized in no way limits the present invention. A better packer seat is achieved due to the downward movement while inflating. Once desired pressure is achieved this pressure is locked in and maintained by a locking ratchet design that cannot release until ¼ round right hand torque is delivered with downward travel of the drill string. This deflates the elements and receives the lower drill collar and latches back in the drill position when very little weight is put on the drill bit. If elected, reverse circulation may be achieved during this procedure.

The drill mode consists of the upper collar receiving the lower collar scoped in. Torque is delivered from the upper collar to the lower collar by a rugged spline section. The spline area is sealed and operates in gear oil, therefore, assuring a clean environment to maximize the life span of the splines and the contact area for weigh transfer. Weight is delivered from the upper collar at the top of the lower collar.

During testing, a multi-flow and multi-shut-in apparatus and method delivers formation pressures, temperatures, and fluid or gas properties to the surface, therefore allowing the test to be engineered efficiently, according to real time data.

BRIEF DESCRIPTION OF THE DRAWINGS

FIG. 2 shows drilling operations with the testing tool in place in the borehole with right hand torque.

FIG. 3 shows partial or total purging of drilling fluid from the inside of the drill stem in preparation for a drill stem test and rotation of tool one-quarter turn left.

FIG. 4 shows lowering the activating tool in preparation of setting the testing tool.

FIG. 5 shows shutting in the formation by inflation of the packer while maintaining left hand torque.

FIG. 6 shows the formation producing up into the drill stem after a portion or all surface pressure is bled off.

FIG. 7 shows deflating the packer after right hand torque.

FIG. 8 is the upper portion of the deactivated tool.

FIG. 8A is the upper portion of the activated tool.

FIG. 9 is the upper spring portion of the deactivated tool.

FIG. 10 is the upper inner collar coupling portion of the deactivated tool.

FIG. 11 is the upper piston and upper hydraulic reservoir of the deactivated tool.

FIG. 12 is the intermediate piston and the intermediate hydraulic reservoir of the deactivated tool.

FIG. 13 is the lower intermediate piston and lower hydraulic reservoir portions of the deactivated tool.

FIG. 14 is the upper packer portion of the deactivated tool.

FIG. 15 is the intermediate packer portion of the deactivated tool.

FIG. 16 is the lower packer and upper float valve portion of the deactivated tool.

FIG. 17 is the hydraulic float valve portion of the deactivated tool.

FIG. 17A is the hydraulic float valve portion of the activated tool.

DETAILED DESCRIPTION OF THE PREFERRED EMBODIMENT

The present invention utilizes an activating tool during a drill stem test. The activating tool may be lowered inside of the drill stem by way of a wireline or pumped down from the surface to seat in a nipple. The nipple is in the drill stem near the formation of interest. When the activating tool seats in the nipple, the formation becomes shut-in. The activating tool can be released from the nipple to allow the formation to produce fluid up into the drill stem. Once released, the activating tool can be retrieved to the surface or reset for additional testing.

Thus, the activating tool acts as a valve inside of the drill stem. The activating tool can be used with a conventional drill stem testing tool, which tool requires the removal of the drill bit from the borehole, or the activating tool can be used with an unconventional testing tool that is lowered into the borehole with the drill bit.

The use of the activating tool 21 with an improved testing tool 201 is described below with reference to FIGS. 8–18 and 8A–18A. In addition to the activating tool, other valves can be used with the testing tool of FIGS. 8–18 and 8A–18A, which provide real time test data and utilize electronic testing equipment.

The testing tool 201 can be used in drilling operations to prevent blow outs and to control thief zones through the utilization of deadman or drop probes. The activating tool 21 is preferably used to conduct a drill stem test. The activating tool can also be used in conjunction with the testing tool 201 to control blow outs and thief zones.

In controlling blow outs and thief zones, the activating tool and the testing tool 201 are used in conjunction with the circulating sub 202, well known in the art, shown in FIGS. 2–7.

A thorough description of the operation of an activating tool 21 is detailed in International Publication WO99/22114, published May 6, 1999, and is incorporated herein by reference for all purposes.

From time to time it is desirable to test the production of a producing well. During such a production test the well is shut-in and the formation pressure is allowed to increase.

The increase in pressure provides useful information on the production capabilities of the well.

Figure 1:
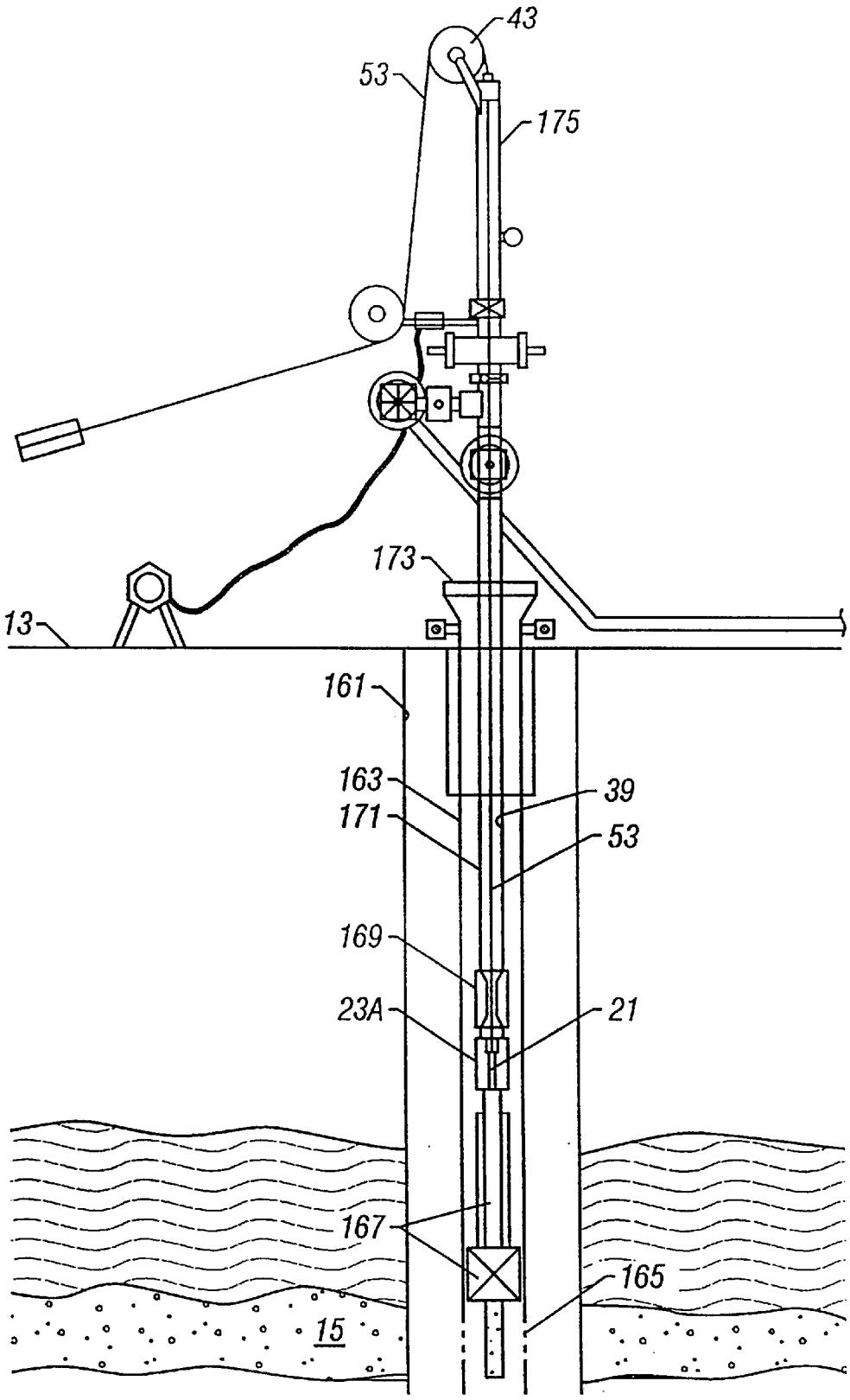
FIG. 1 is a longitudinal cross-sectional view of a production well.

In FIG. 1, there is shown a view of a producing well 161. The well 161 extends in the formation of interest 15. Production equipment is in place. This equipment includes casing 163. The casing is perforated 165 at the formation 15. A packer 167 isolates the formation 15. The nipple 23A is located above the packer 167. Located above the nipple 23A is a standard seating nipple 169 found in many producing wells. A string of tubing 171 extends from the standard nipple 169 to the surface 13. A well head 173 and other equipment is also provided. The nipple 23A is installed downhole when the well is completed or when the tubing string is pulled.

During drilling operations, an activating tool 21 may be inserted into the well via a lubricator 175. A wireline 53 is used to raise and lower the activating tool 21 for a drill stem test or pumped down for blow out control.

The activating tool 21 can be used to shut-in the production well and acquire pressure data. The activating tool 21 is lowered down inside the tubing on a wireline 53. It seats inside of the nipple 23A, as discussed hereinbelow. Once the activating tool is seated, the well is shut-in from a downhole location. Formation pressure is allowed to build, which build up is recorded by the activating tool instrumentation.

The well need only be shut-in for a relatively short time (for example, 24 hours) compared to conventional production well testing. Because the well is shut-in from a downhole location close to the formation, the entire column of tubing 171 need not be pressurized by the formation pressure, as with conventional testing. Therefore, use of the activating tool in a production well test saves time.

After the well has been shut-in for a suitable period of time, the activating tool is released from the nipple 23A, as discussed hereinbefore. The activating tool is then retrieved to the surface, for analysis of the data.

With the exception of the seals, which are made of rubber, the nipple and the activating tool are made of metal.

Figure 2:
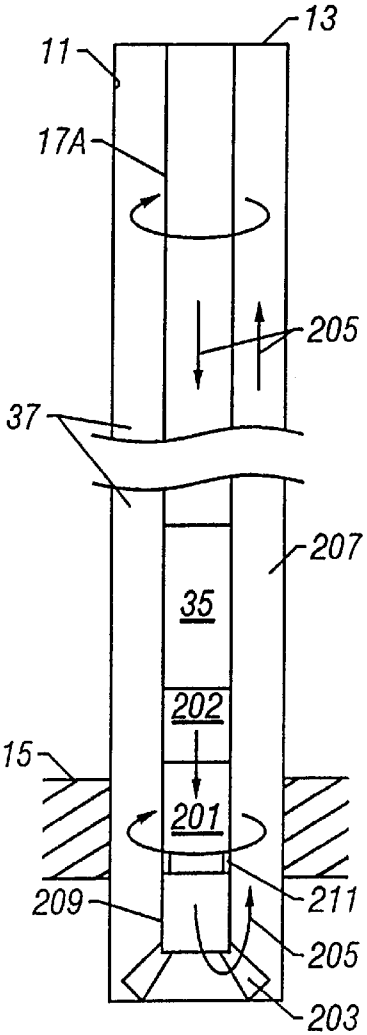

FIGS. 2–7 show the sequence of operation for a drill stem test. In FIG. 2, the borehole 11 is being drilled. The drill bit 203 is in place on the bottom of the borehole and the drill stem 17A is being rotated. Drilling proceeds in accordance with conventional techniques. For example, weight is applied to the drill stem at the surface 13, and drilling fluid 205 is circulated down through the drill stem 17A, out through jets or orifices in the drill bit 203 and up by way of the annulus 207, where the drilling fluid returns to the surface 13.

Beginning at the bottom and working towards the surface, the drill stem or drill string 17A is made up of th drill bit 203, its associated float sub 209, the testing tool 201, a circulating sub 202, drill collars 35, and drill pipe 17A. The testing tool 201 is preferably located immediately above the drill bit 203 and its sub 209, although the testing tool can be located higher up the drill stem.

The testing tool 201 is thus part of the drill stem 17A. As the drill stem is rotated, so too is the testing tool. The testing tool 201 transmits the rotational force needed to rotate the drill bit for drilling. In addition, weight applied to the bit during drilling is also transmitted through the testing tool 201.

Figure 4:
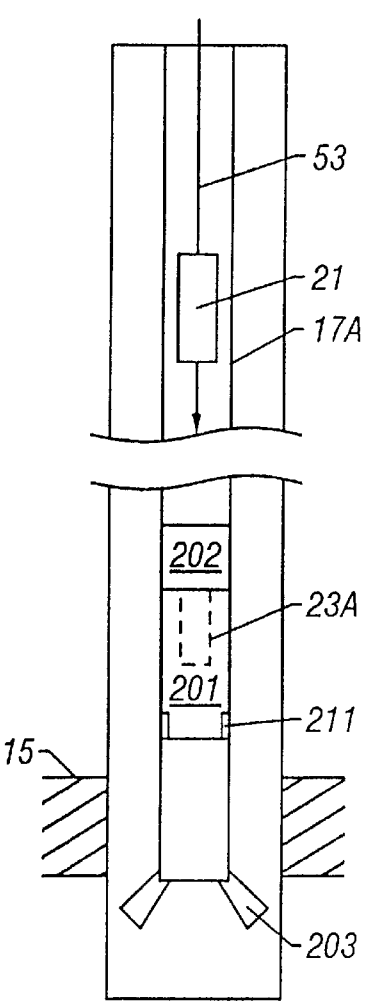
FIGS. 2–7 are schematic views of a well borehole showing the various stages in the operation of the testing tool of the present invention, in accordance with a preferred embodiment in order to conduct a drill stem test.
Figure 3:
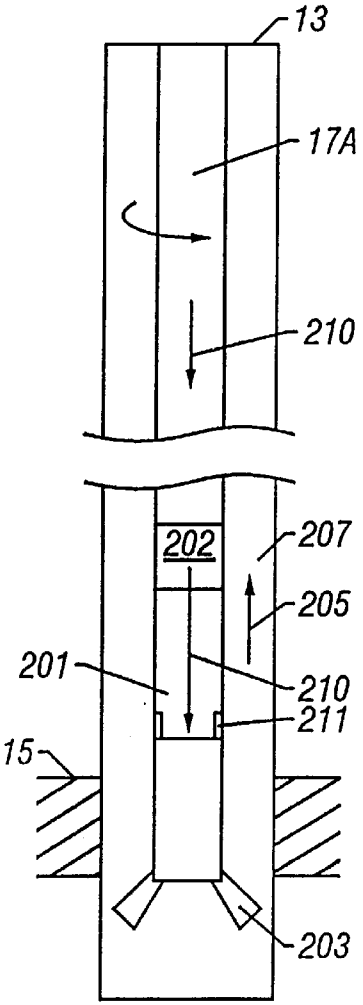
Figure 5:
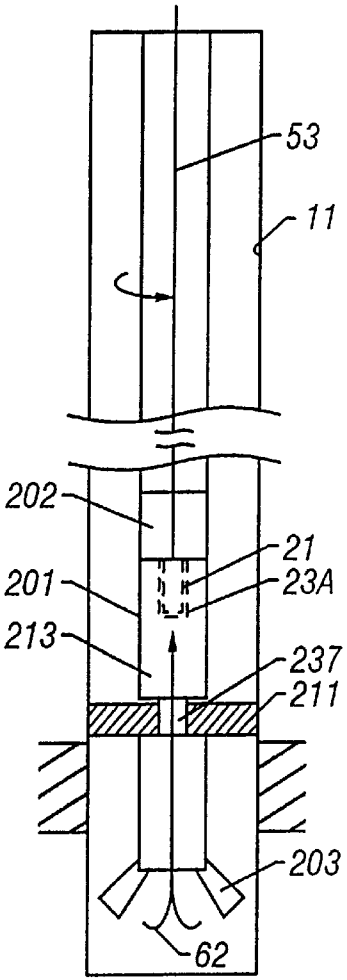

When the borehole penetrates a formation 15 of interest, the decision is made to conduct a drill stem test. In FIGS. 3–5, the borehole 11 is readied for the test. In FIG. 3, the drill stem 17A is left hand torqued one-quarter turn (counterclockwise) to align the latching collet 219 and is then picked up a determined distance in order to position the packer above the zone at a suitable place for a good packer seat. Next, because the drill stem is full of drilling fluid, the drill stem may be purged by pumping in compressed gas 210 (or lighter fluid) from the surface. For example, compressed nitrogen gas can be used. As the compressed gas traverses down inside of the drill stem 17A, the drilling fluid is pushed out of the bottom of the drill stem. The drilling fluid flows up to the surface via the annulus 207. In this manner, the inside of the drill pipe stem may be partially or totally purged of drilling fluid.

With the testing tool 201 still suspended above the formation 15, as shown in FIG. 4, the testing tool is set. The testing tool is set by lowering the activating tool 21 on a wireline 53 down inside of the drill stem 17A. The inside of the testing tool 201 contains an accommodating nipple 23A for receiving the activating tool. The activating tool 21 engages the nipple 23A. The inside of the drill stem 17A is now closed by the activating tool 21. The pressure exerted by compression inside of the drill stem causes the nipple 23A to slide downwardly and then causes a packer 211 (or more than one packer) to inflate (FIG. 5) against the walls of the borehole 11. In the present preferred embodiment more than one packer is utilized. The ability to use one or more packers of differing characteristics is a unique feature of the present invention as will be discussed below. The packer inflates as it extends and wipes the borehole wall. This helps provide a clean area to seal off the formation.

Once inflated, the packer 211 packs off the annulus 207 above the formation 15. The formation is now shut-in by the inflated packer 211 and also by the activating tool-nipple arrangement 21, 23A, which forms a seal inside of the drill stem. In FIG. 5, the formation fluid or gas 62 is shown as an arrow. The flow of fluid or gas inside of the drill stem is stopped by the activating tool and nipple.

The test then enters an initial flow period. To enter the flow period, the valve inside of the testing tool is opened, namely by manipulating the activating tool 21. Fluid or gas 62 from the formation flows through the testing tool up into the drill stem 17A. After desired flow and initial shut-in periods, the activating tool 21 is released from the nipple and retrieved to the surface 13. The activating tool can be used to retrieve a fluid sample as well as contain instrumentation to record pressure, temperature, and other parameters, such as gradients, to determine what kind of fluid is in the drill pipe. When the activating tool reaches the surface, the sample and recorded information can be inspected. Currently, fluid properties and pressure information may be analyzed in real time by the use of electronic test equipment.

The well can undergo repeated shut-in and flow periods (FIGS. 5 and 6, respectively) by seating and releasing the activating tool 21. Some surface manipulation of pressure above the activating tool may be necessary to assist in seating the activating tool. Once inflated, the packer remains inflated, independently of the activating tool activity.

Figure 7:
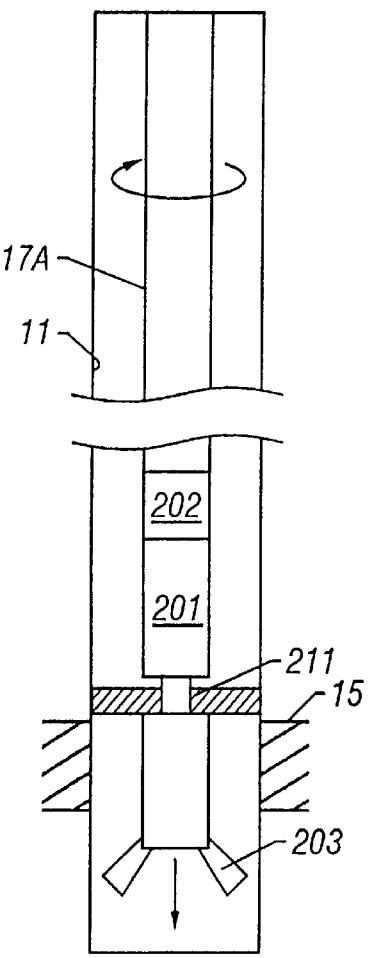
Figure 6:
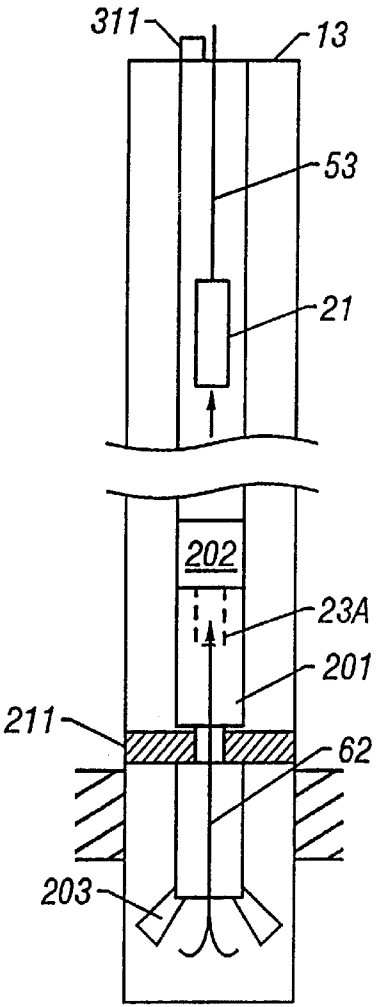

After the drill stem test has been completed, the testing tool 201 is reconfigured for drilling. The drill stem 1 7A is rotated slowly to the right (very little travel is needed to free the collett teeth 242) and then eased to the bottom of the borehole (FIG. 7). The rotation and lowering of the drill stem allows the lower portion of the drill stem 17A to retract and the hydraulic fluid to reenter the reservoirs thereby allowing the packer 211 to deflate. As the packer is deflated, the borehole undergoes reverse circulation by surface control. When the packer is released from the borehole, the annulus drilling fluid will flow into the drill stem, thus displacing the formation fluids or gas to the surface where they may be contained. After weight is applied to the bit, the testing tool 201, and the remainder of the drill stem 17A, are again ready for drilling (see FIG. 2).

Figure 13A:
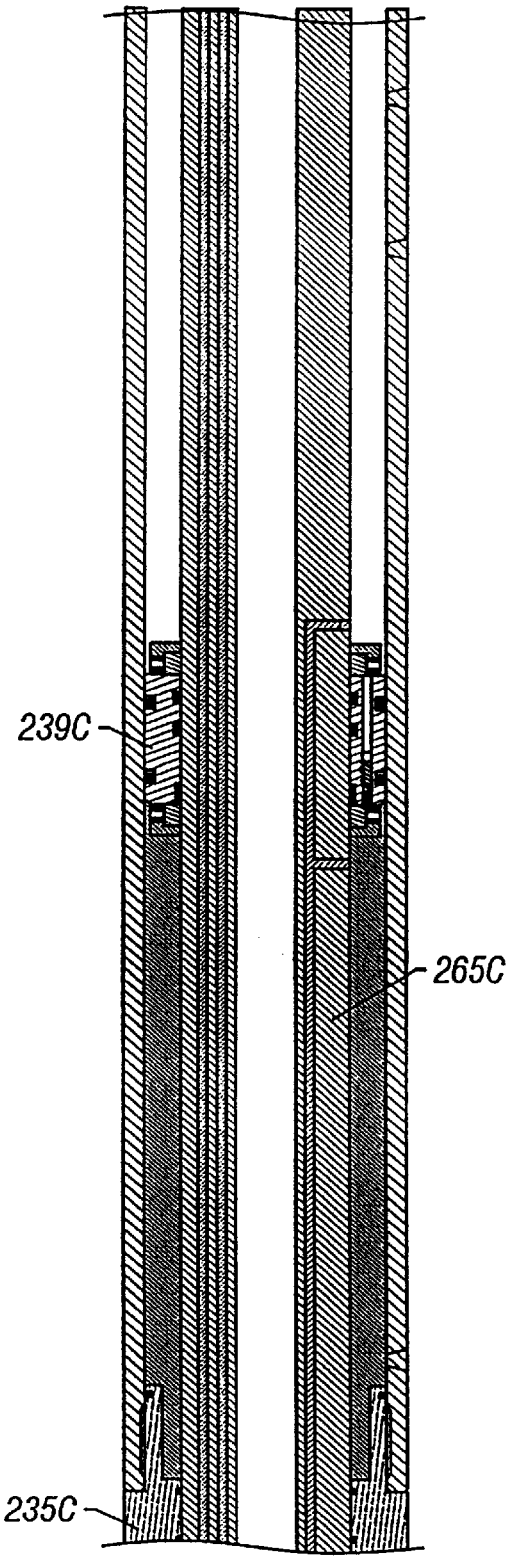
FIG. 13A is the lower intermediate piston and lower hydraulic reservoir portions of the activated tool.
Figure 13:
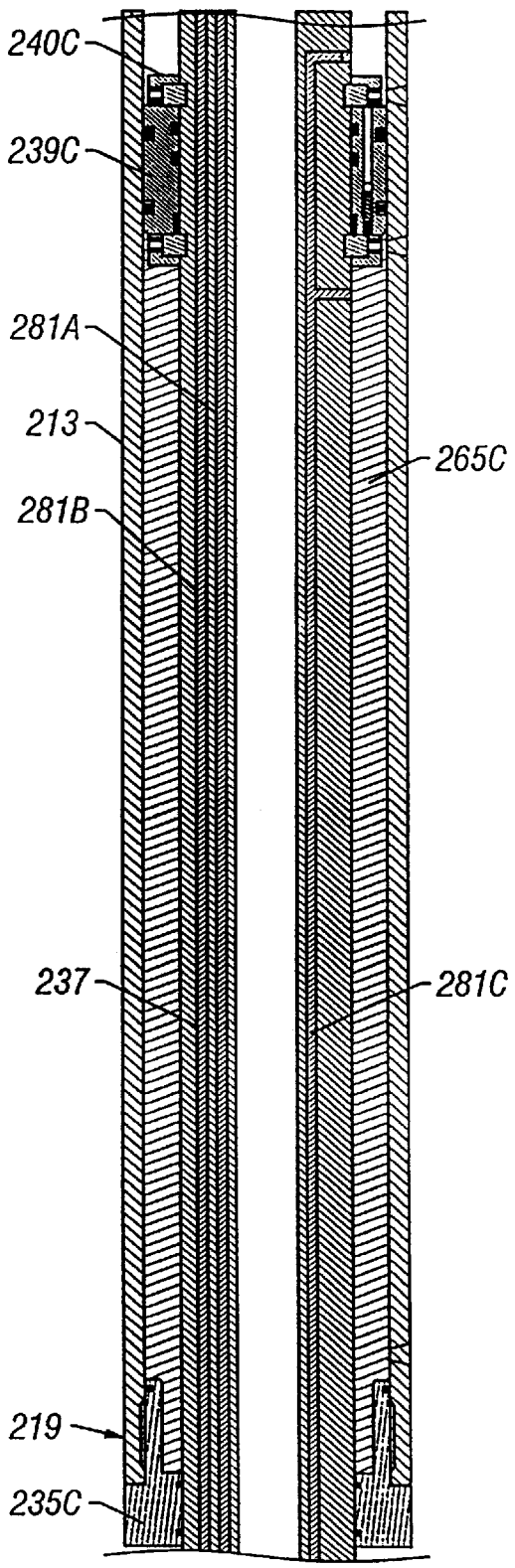

The testing tool 201 of FIGS. 8–18 and 8A–18A will now be described in detail. The testing tool 201 includes an upper testing collar 213 and an inner assembly 215. The upper testing collar 213 is generally tubular, having an upper end 217 and a lower end 219 (FIG. 13). The upper testing collar 213 forms a housing for the inner assembly 215. The upper end 217 (FIG. 8) is coupled to a drill collar (not shown). The lower end 219 (FIG. 13) is located adjacent to the packer section.

The upper testing collar has an interior cavity 221 that extends from the upper end 217 to the lower end 219. The interior cavity 221 has a number of characteristics, which will be described beginning near the upper end 217 and proceeding toward the lower end 219. Near the upper end of the interior cavity 221 is an abutment shoulder 223 (see FIG. 8A) which extends radially inward. The top side 223A of the shoulder slopes inwardly, but the bottom side 223B is perpendicular to the longitudinal axis L of the tool 201. Below the shoulder 223 is a restriction c-ring groove 224. Further, below the c-ring groove 224 is an upper shoulder 226. Sliding sleeve sealing O-rings 100 are just above the stop shoulder 226 and fit into o-ring notches 101 (FIG. 8). A short distance away (FIG. 9), the interior cavity 221 narrows slightly in its inside diameter forming a small circumferential beveled shoulder 227 to cooperate with teeth 242 of collet 219. The interior cavity 221 extends lower and gradually tapers to a wider diameter to accept a number of splines 231 having teeth 231 A. The top of which is where drilling weight is transferred. (See FIGS. 9, 9A, 18 and 18A.) The splines 231 extend longitudinally along the inside of the upper testing collar 213 and project inwardly toward the longitudinal axis L of the tool. In the preferred embodiment, there are four splines 231, spaced 90° apart around the circumference of the inner cavity (see FIGS. 18 and 18A). However, there can be more or fewer splines. The splines 231 are separated from each other by channels 232. Channels 232 are release grooves for the collett teeth 231A to free-travel in. The lower end of the splines 231 form a shoulder 233.

Figure 9A:
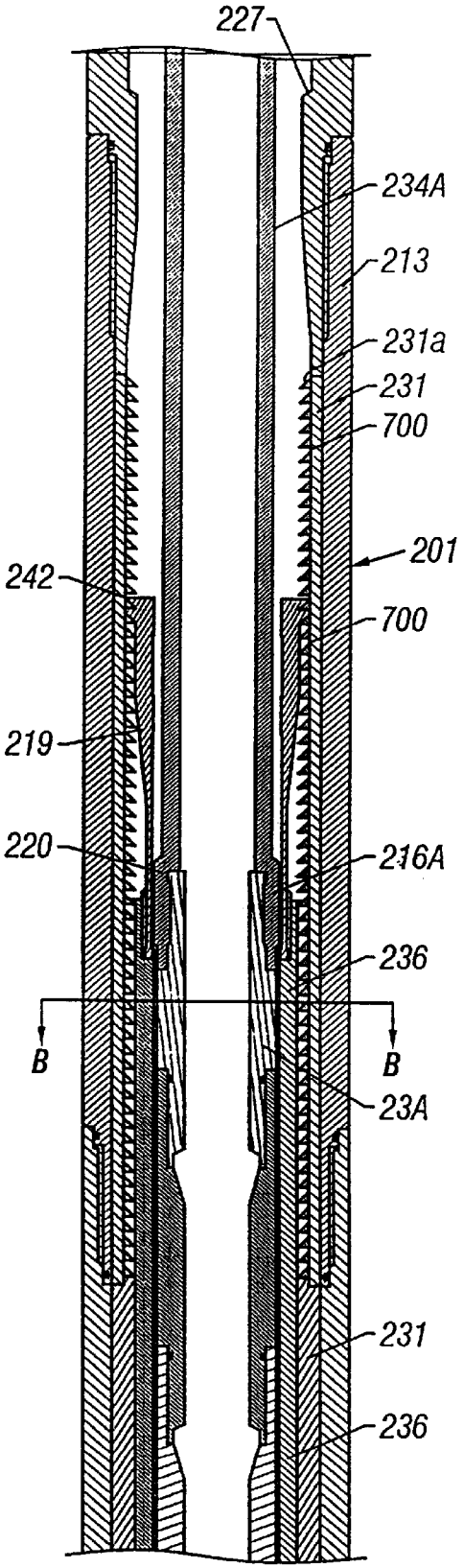
FIG. 9A is the collet portion of the activated tool.
Figure 9:
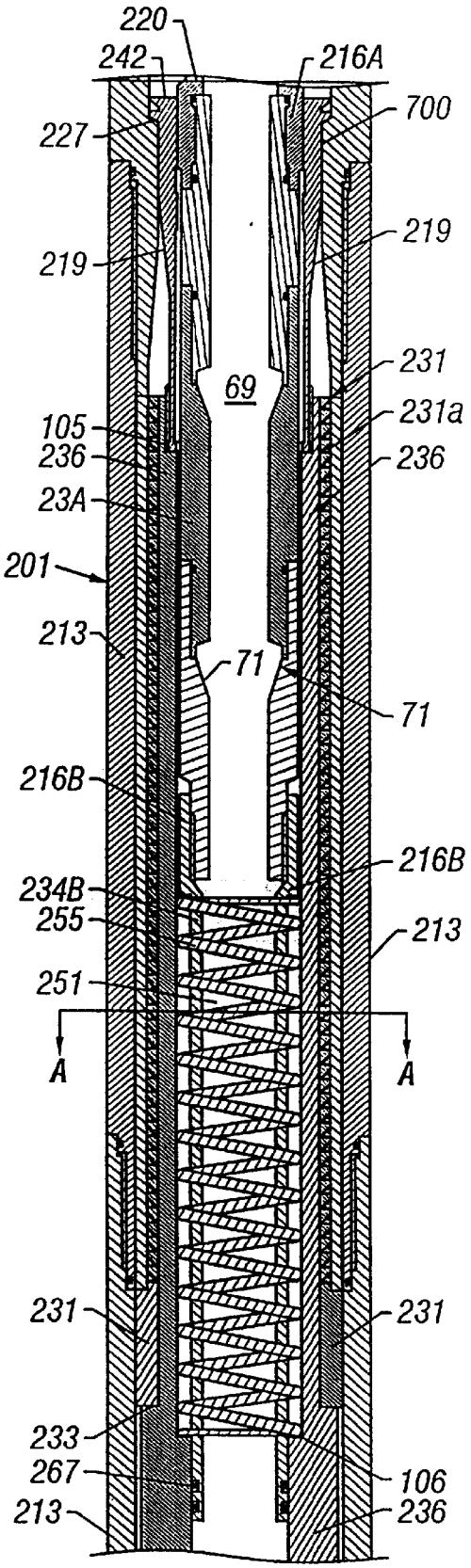
Figure 18A:
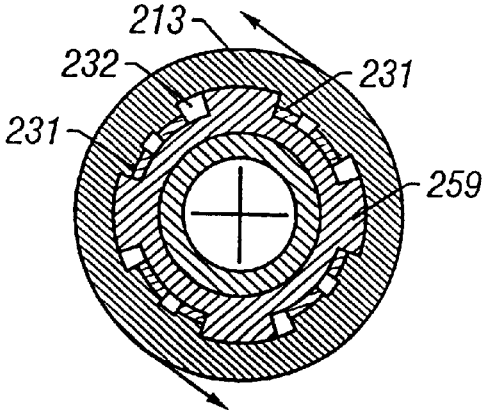
FIG. 18A is a transverse cross-sectional view of the activated testing tool taken through line B—B of FIG. 9A.
Figure 18:
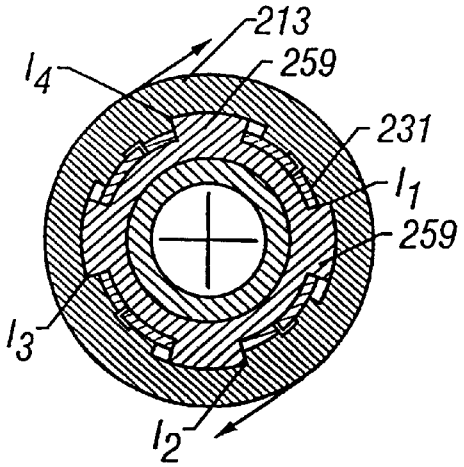
FIG. 18 is a transverse cross-sectional view of the deactivated testing tool taken through line A—A of FIG. 9.

FIG. 18 is a cross-sectional view of the deactivated testing tool taken through line A—A of FIG. 9. This shows the tool in the drilling position. The upper testing collar 213 has splines 231 at 90° with channels 232 between each spline section. Cooperating mandrel spline sections 259 are shown in contact with upper testing collar splines 231 along intersections $I_1$, $I_2$, $I_3$, and $I_4$. Drilling torque is transferred along these intersection.

By rotating the upper testing collar 213, one-quarter turn left (counterclockwise), the tool is ready to be activated for testing. FIG. 18A shows this slight rotation. The rotation allows the collet teeth 242 (FIG. 8) to rotate into alignment with the spline teeth 231A.

Figure 11A:
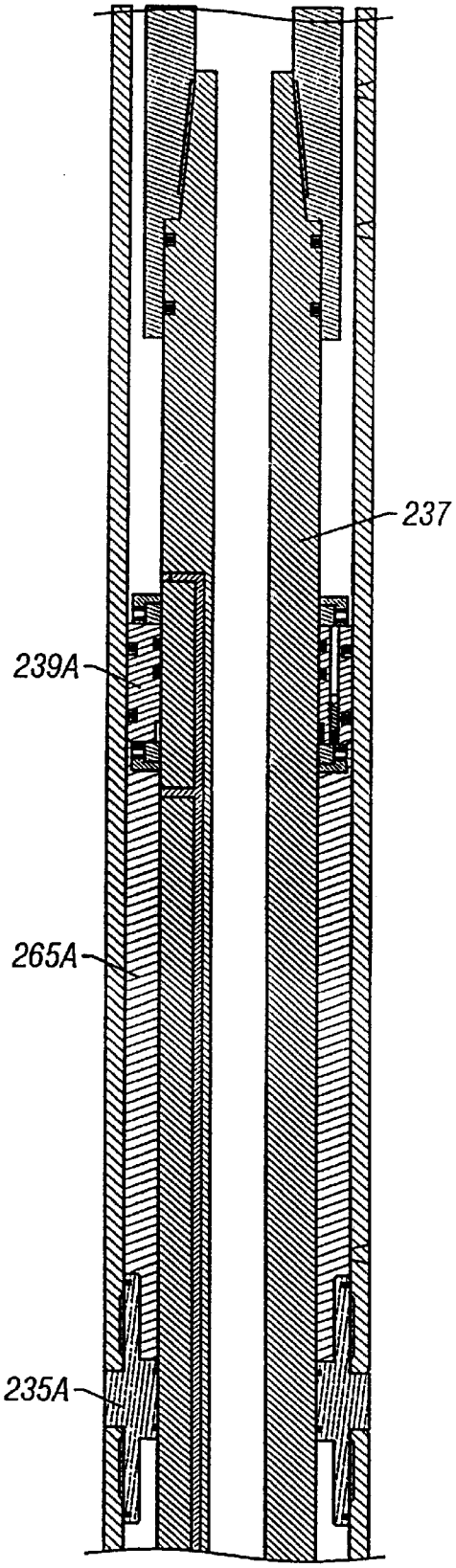
FIG. 11A is the upper collar coupling and upper piston portions of the activated tool.
Figure 11:
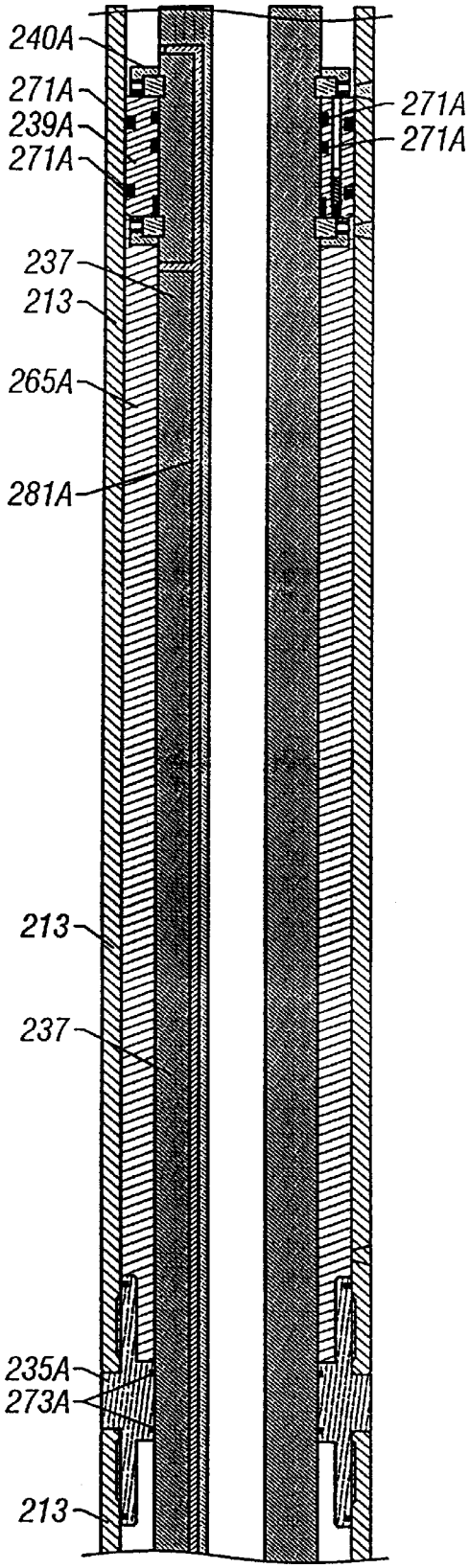

Below the splines, the interior cavity 221 continues toward the lower end 219, wherein a piston 239A is encountered (see FIG. 11). The piston head 240A, which is ring shaped, is perpendicular to the longitudinal axis of the tool and projects inwardly. Below the piston 239A, the interior cavity 221 continues to the lower end 219 of the upper collar. The lower end 219 is closed.

The inner assembly 215 includes an upper sliding sleeve 234A, a nipple 23A, one or more pistons 239A–239C, a spline mandrel 236, a lower sliding sleeve 234B, a packer mandrel 237, and one or more packers 211A–211C. The upper sliding sleeve 234A slides in interior cavity 221 as will be discussed below.

At the topmost end 218 of sleeve 234A is a circumferential groove 103 which retains restriction c-ring 104 (FIG. 8). The lower end 220 of upper sleeve 234A is attached to nipple 23A at an upper sleeve collar portion 216A (FIG. 9).

Upper sliding sleeve 234A guides and aligns the movement of the nipple 23A. Further, the restriction c-ring 104 cooperates with groove 224 to hold the nipple 23A in a proper location during deactivation of the tool 201.

The outside diameter of the collar 216A is greater than the outside diameter of the upper sleeve section. The lower sliding sleeve 234B is provided with sealing O-rings 267 at its lower end and has a circumferential lower sleeve collar 216B which fits over and attaches to the lower end of nipple 23A. Again, the outside diameter of lower sleeve collar 216B is greater than the outside diameter of the lower sliding sleeve 234B.

Figure 10A:
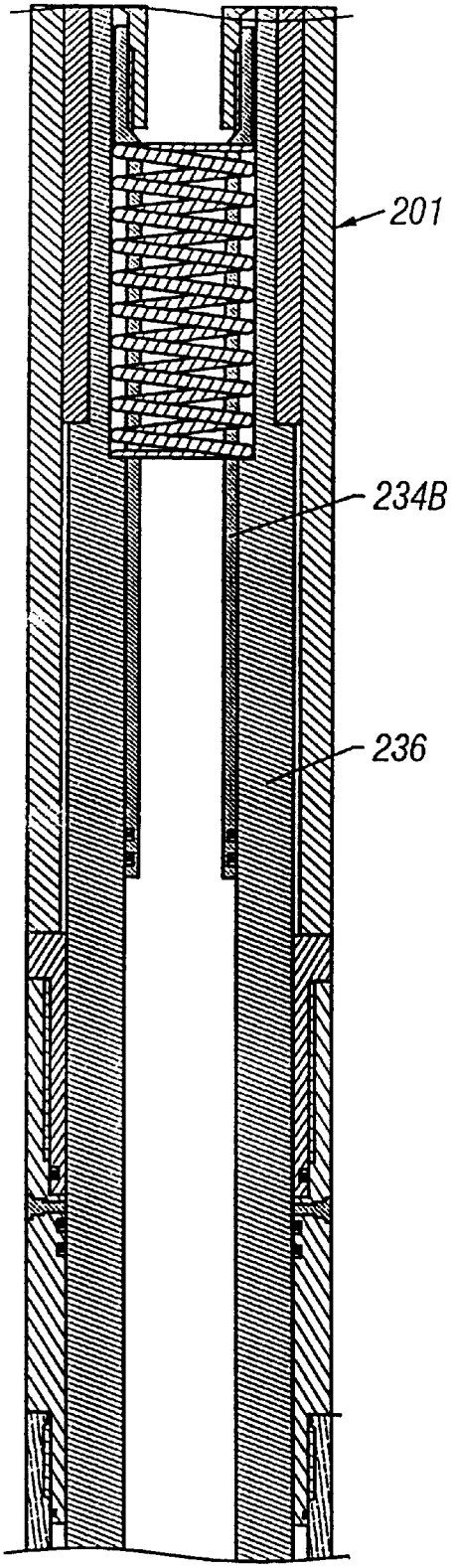
FIG. 10A is the compressed spring portion of the activated tool.
Figure 10:
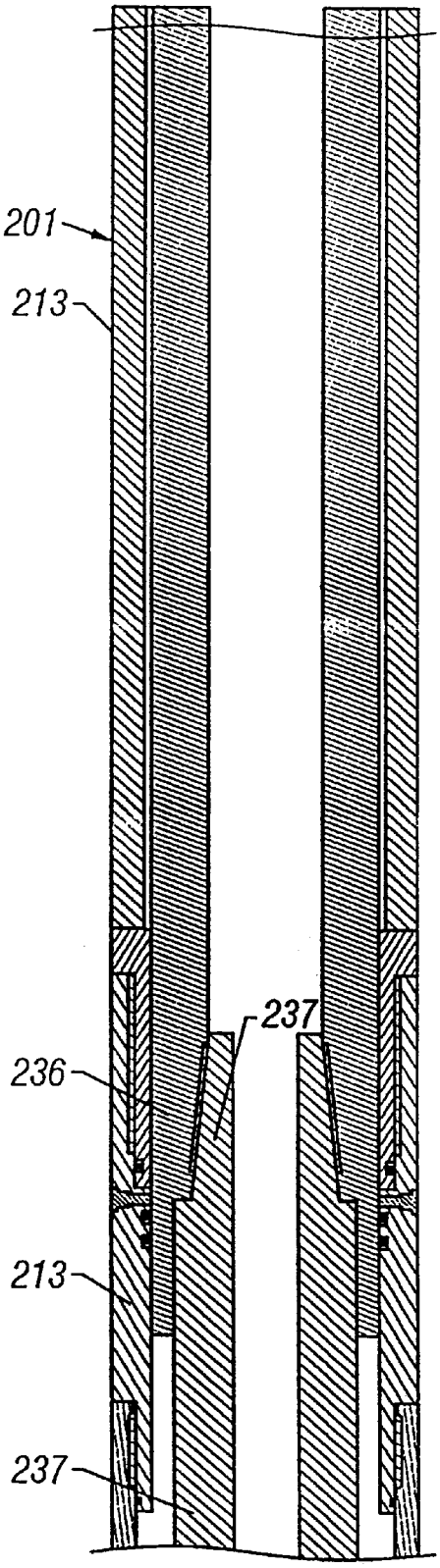

The spline mandrel 236 fits circumferentially around nipple 23A. An upper shoulder 105 on the spline mandrel supports and retains collet 219 having teeth 242. Shoulder 105 also limits the downward travel of the sleeve 220. A lower shoulder 106 extends inwardly around mandrel 236 and serves as an abutment for coil spring 255. The mandrel lower end 233 attaches to the packer mandrel 237 (FIG. 10).

Turning to FIGS. 8 and 9, it may be seen that when upper sliding sleeve 234A is in drilling position, collet 219 fits around upper sleeve collar 216A with teeth 242 urged into engagement with beveled shoulder 227. The collet teeth cannot move inwardly because upper sleeve collar 216A restrains such movement. Further, splines 231 are in drilling engagement with the splines 259 of the spline mandrel 236.

A chamber 251 is formed in the interior cavity 221 in the upper testing collar 213. The chamber, which extends from the shoulder 223A near the top of tool 201 (FIGS. 8 and 8A) to upwardly facing lower abutment shoulder 106 on the splines mandrel 236 containing the nipple 23A. The nipple 23A can slide up and down within the chamber 251. A helical coil spring 255 is located between the lower abutment shoulder 106 and the lower sliding sleeve collar 216B, wherein the nipple 23A is biased upwardly.

The cooperation between the collet 219 and the toothed splines 231 are important to the positive locking feature of the present invention. When the tool 201 is in the drilling position (shown in FIGS. 8–18), the collet 219, the collet teeth 242, and the spline teeth 231 A are not engaged and the drilling forces and torque are transmitted through the splines 231 and 259, as will be described below. However, once the drilling has ceased, the tool rotated one-quarter turn counterclockwise, and the activating tool 21 seated in the nipple 23A, the collet teeth 242 have been aligned with the spline teeth 231 A. As the collet 219 moves downwardly, the teeth 242 engage the spline teeth 231A. The flat surface of the collet teeth engage the flat surface of the spline teeth (see FIG. 9A). Thus, the spline mandrel 236 and the nipple 23A cannot move upwardly until the upper testing drill collar 213 is rotated clockwise a quarter of a turn to move the collet teeth 242 out of alignment with spline teeth 231 A and into channel 232.

Figure 16A:
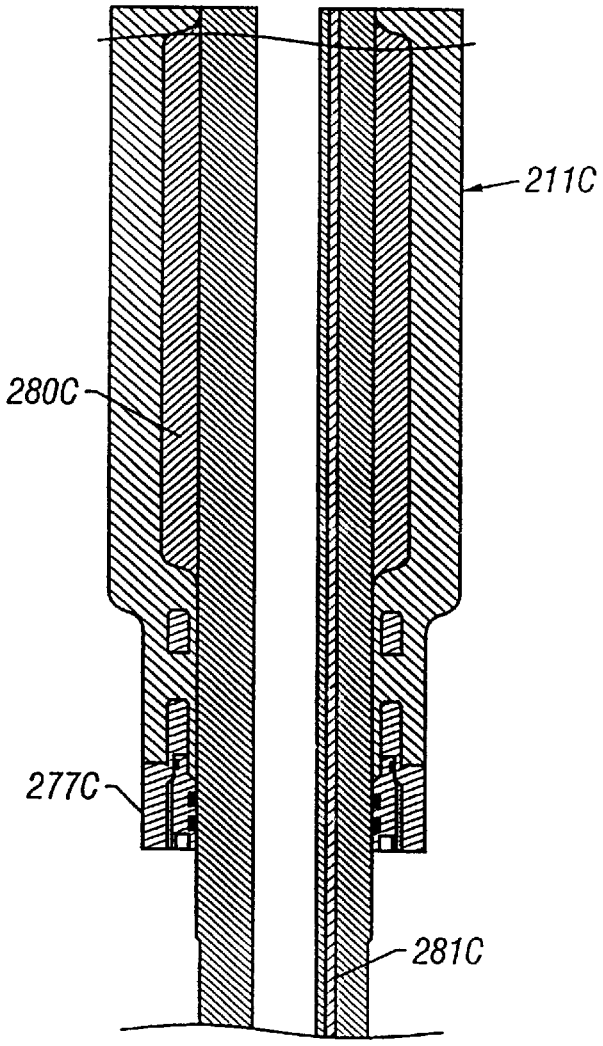
FIG. 16A is the lower packer portion of the activated tool.
Figure 16:
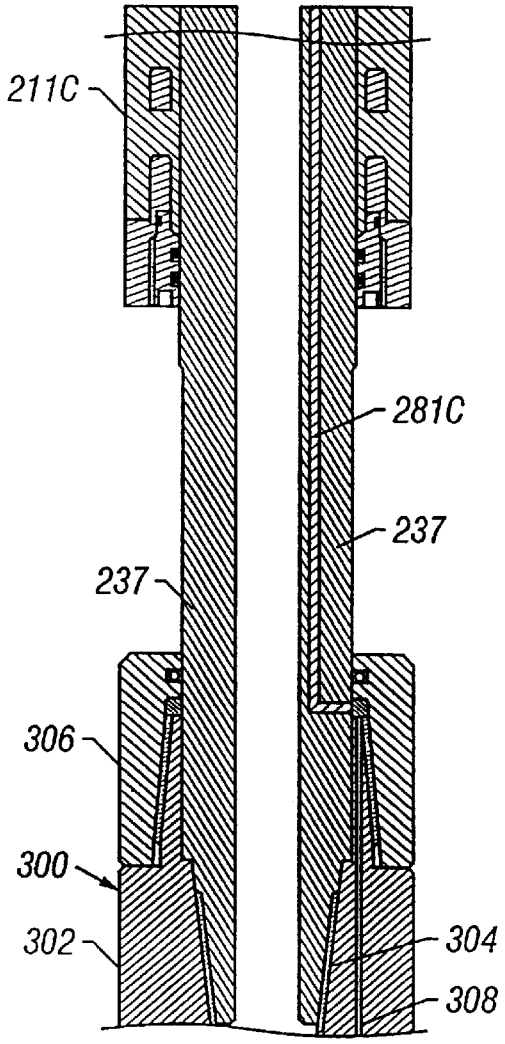

FIG. 10 illustrates the coupling of the packer mandrel 237 with the inner spline mandrel 236, thus as the inner spline mandrel moves up and down within the borehole during the activation of the testing tool, the packer mandrel also moves up and down. The packer mandrel extends the length of the tool 201 from the spline mandrel 236 (FIG. 10) to the hydraulic float valve 300 assembly (FIG. 16).

There are a number of compartments 265A–265C formed in the annular region between the packer mandrel 237 and the upper testing collar 213. These compartments form separate annular reservoirs for holding compressible fluid used to inflate the packer elements and operate a hydraulic float valve situated downstream on the tool string. FIG. 11 shows how the upper reservoir 265A is bounded at its upper end by piston 239A and at its lower end by connector sub 235A which is fixed to the upper testing collar 213. The piston 239A is connected to the packer mandrel 237 and slides relative to the upper testing collar 236. The piston 239A is ring-shaped around the packer mandrel. The piston has seals 271A around its outer diameter and also around its inner diameter.

The connector sub 235A (FIG. 11) has seals 273A, such as O-rings, around its inside diameter to provide a seal against the packer mandrel 237. The packer mandrel 237 can slide through the sub 235A.

Similarly, an intermediate reservoir 265B (FIG. 12) and a lower reservoir 265C (FIG. 13) are provided downstream on the tool 201. It should be understood that each reservoir has associated pistons 239B and 239C, ring systems 271B and 271C, subs 235B and 235C with seals 273B and 273C, and independent oil feed conduits to each packer.

Figure 14A:
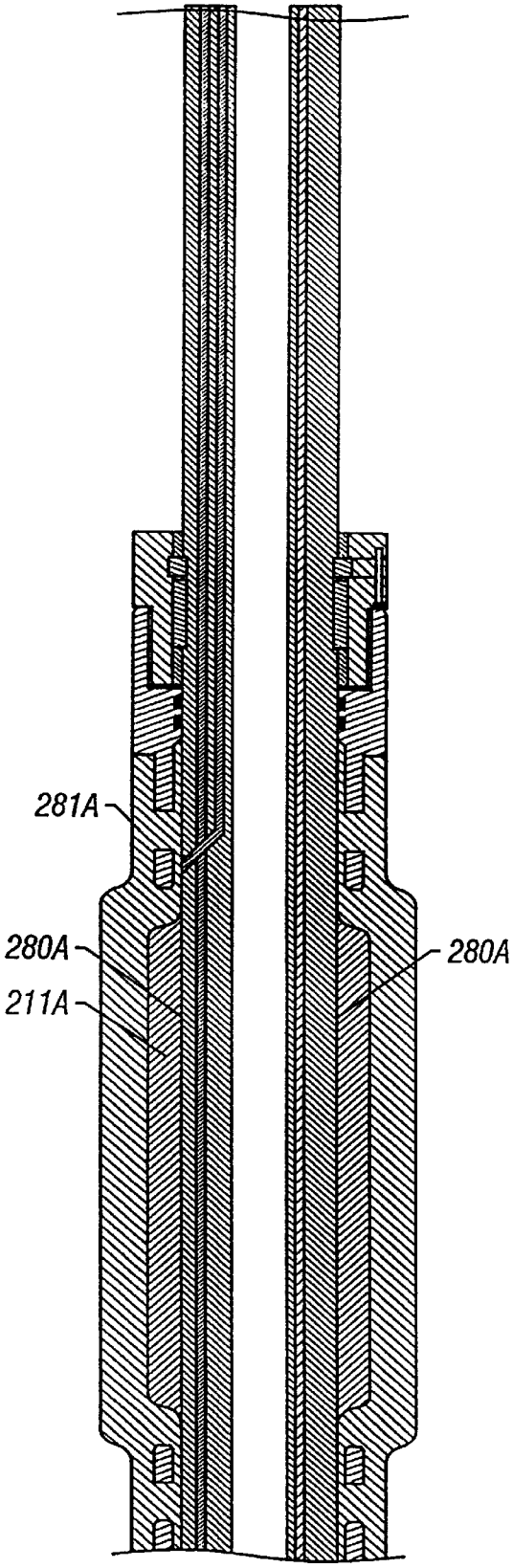
FIG. 14A is the upper packer portion of the activated tool.
Figure 14:
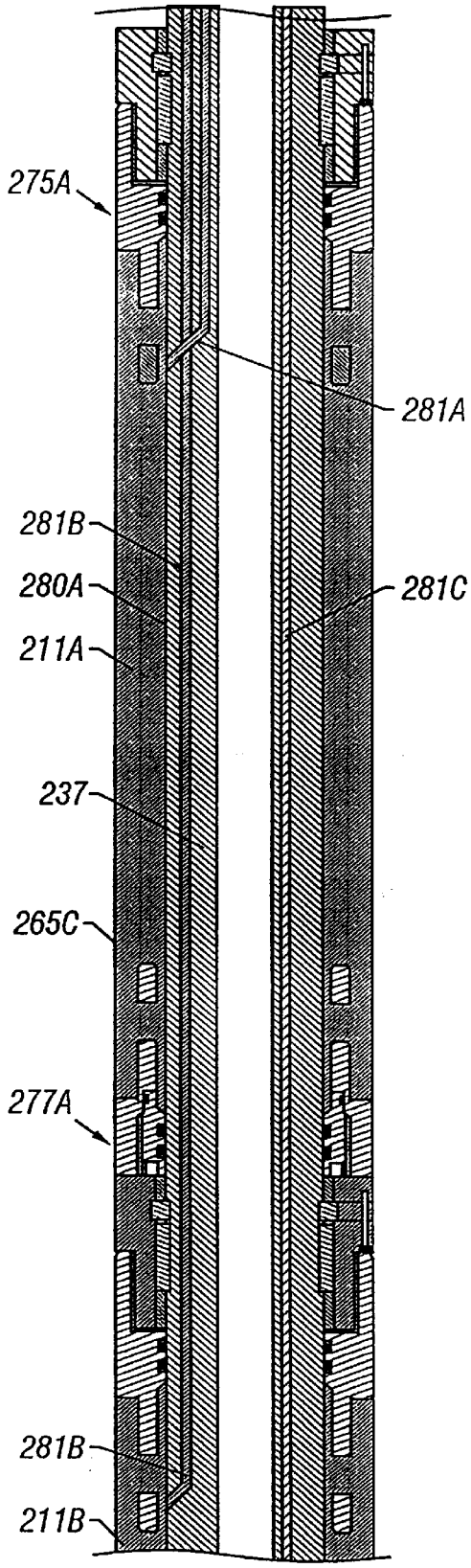

Still further downstream on the packer mandrel are a series of packer elements associated with each reservoir. FIG. 14 illustrates the first such packer 211 A mounted to mandrel 237 by packer heads 275A and 277A. The upper head 275A is fixed to the packer mandrel 237 while the lower head 277A is slidably coupled to the mandrel 237. The heads have seals around their inside diameters to seal between the heads and the mandrel. The packer element is connected between the upper and lower heads. The packer may be made of rubber such as a 70–90 durometer buna rubber or any other suitable material that is oil resistant.

There is an interior annular chamber 280A formed around the mandrel 237 which fills with hydraulic fluid from reservoir 265A during activation of the testing tool 201. FIG. 14A shows the packer 211A inflated with fluid in chamber 280A. The injection of fluid is achieved by fluid passing through fluid conduit 281A from the reservoir 265A to chamber 280A during the compression of the fluid by the downward movement of the piston 239A as will be described below.

Similarly, an intermediate packer 211B (FIG. 15) and a lower packer 211C (FIG. 15) are provided downstream on the mandrel 237. It should be understood that each packer has associated upper 275B and 275C and lower 277B and 277C heads, interior chambers 280B and 280C, fluid conduits 281B and 281C.

One of the unique features of the packer system of the present invention is the ability to provide packers with different pressure capabilities on one tool. Thus, as the well is drilled to deeper depths, it is possible to inflate the lowest packer to a higher pressure by varying the construction of the bladder and the volume of the fluid injected by the same displacement of the piston.

Figure 15A:
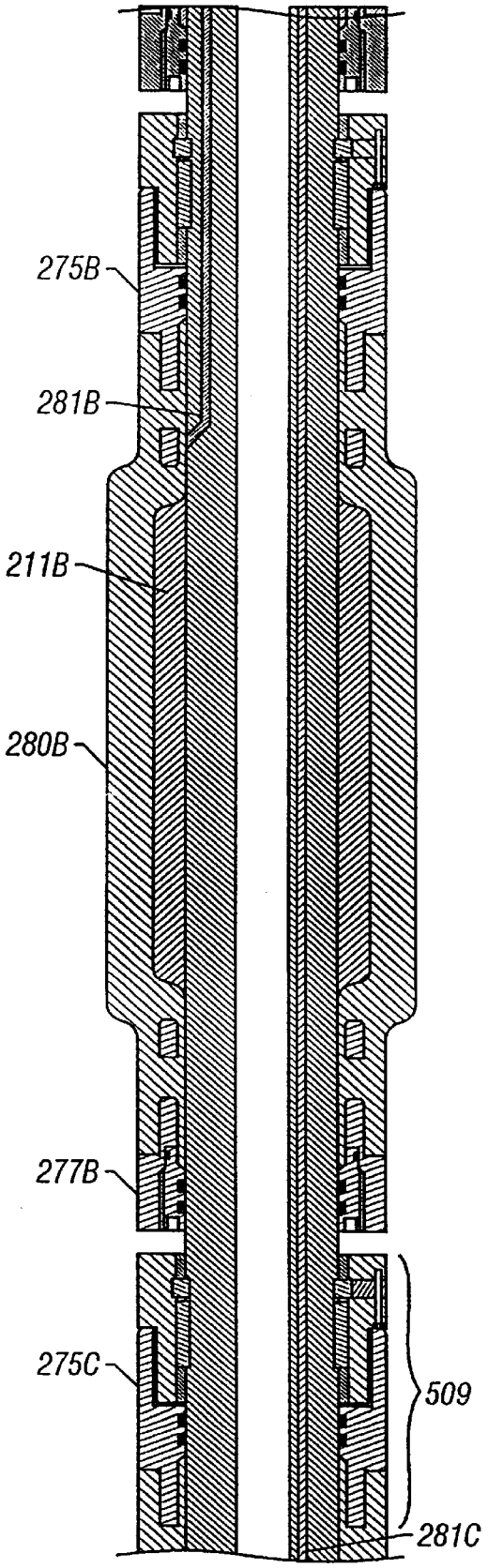
FIG. 15A is the intermediate packer portion of the activated tool.
Figure 15:
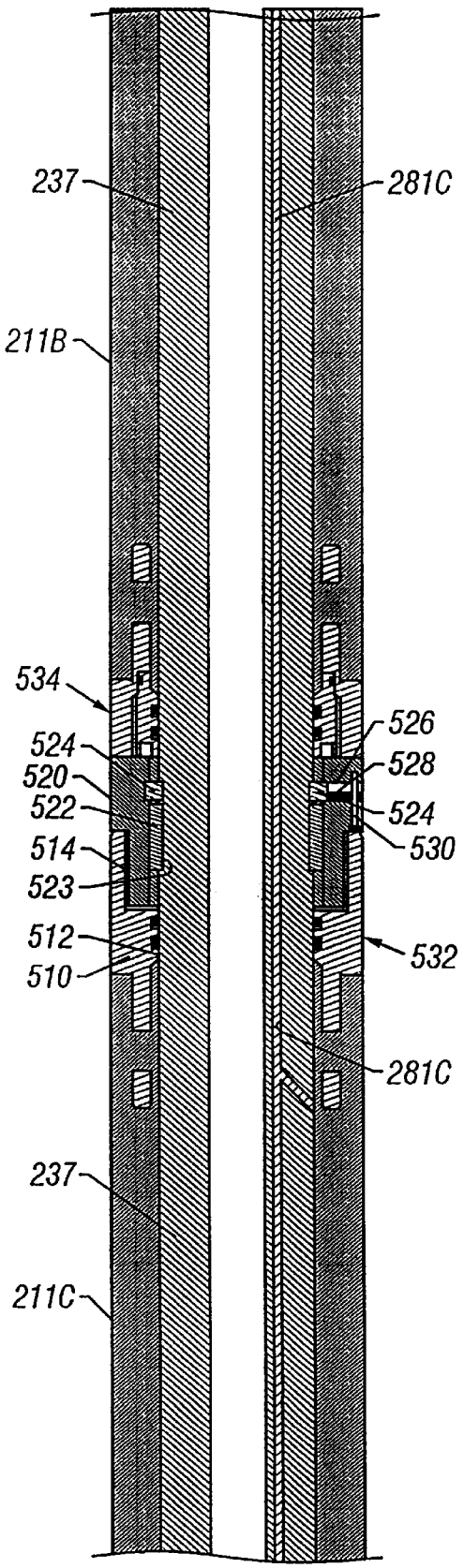

A unique packer head locking 509 assembly is provided in the present invention as shown in FIGS. 15 and 15A. A packer header 510 is attached to the packer element 211C and is provided with seals 512 which urge against the packer mandrel 237. Internal threads 514 are provided on the header 510 to threadingly attach the header 510 to a keyed, non-rotating locking head 520. Locking head 520 is attached to the mandrel 237 by key 522 in keyway 523 in the mandrel. This prevents the locking heads from rotating around the mandrel. To further retain the locking head, a four-section, quadrant locking ring 524 is inserted through opening 526 in locking head 520. Once the four sections of the ring 524 are in place a door closure 528 is inserted into the opening 526. A lock bolt 530 is set through the door and into the locking head to retain the segmented locking ring in place. The locking ring 524 prevents the locking head 520 from moving up or down the mandrel. The packer header 510 may then be threadingly attached to the locking head 520.

The fixation of the packer head locking assembly to the mandrel ensures that the top end of the packer 532 does not move up, down, or rotate on the mandrel when inflated or during drilling operation when the packer is deflated. Further, the lower end 534 of an upstream packer is restricted in downward movement when it abuts against a locking assembly 509 immediately below it.

Figure 17A:
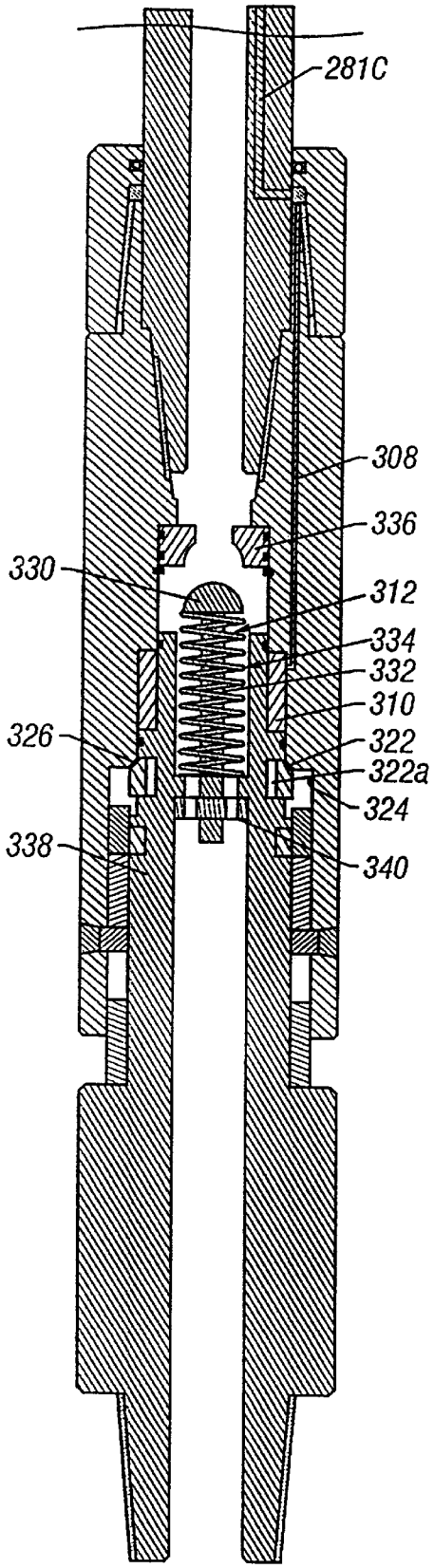
Figure 17:
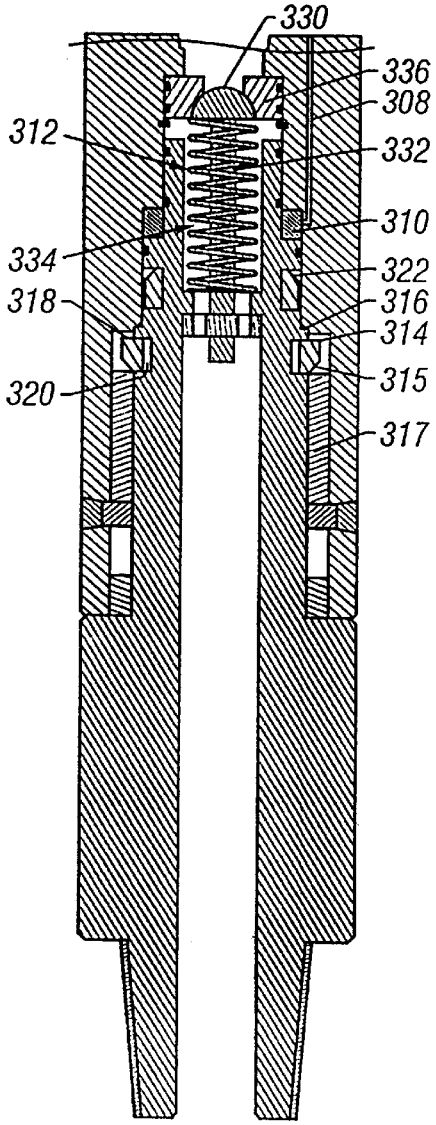

Downstream of the last packer 211C is a hydraulic float valve assembly 300 shown in FIGS. 16 and 17. The float valve assembly body 302 is threadingly attached to the packer mandrel end threads 304 on the distal end of the mandrel. The body 302 is further retained to the mandrel by retaining collar 306 (FIG. 16).

A hydraulic fluid conduit 308 extends through the body 302 and is in fluid communication with fluid conduit 281C. Thus when fluid pressure is increased by the movement of piston 239C as described above, fluid is forced through hydraulic fluid conduit 308 into fluid chamber 310, opening the poppet valve assembly 312 (as seen in FIG. 17A).

The pressure necessary to control the opening of the poppet valve assembly 312 is determined by the unique restriction c-ring 314. C-ring 314 is designed to collapse in a specified pressure range based upon its material composition, the slope of the restriction shoulder, and thickness of the ring. As may be seen in FIG. 17, c-ring 314 has a leading tapered restriction shoulder 315 which urges against a collapsing collar 317. As pressure increases in fluid chamber 310, abutment flange 316 presses against upstream side 318 of the c-ring 314. When the specific pressure range is reached the ring 314 collapses inwardly into groove 320 (as seen in FIG. 17A) and poppet valve assembly 312 slides downwardly. A second restriction c-ring 322 releases from groove 324 and urges against shoulder 326 extending inwardly from the housing 302 keeping the valve open, even when hydraulic pressure is released from chamber 310.

From this description of the valve 312 operation, it may be seen that fluids from the downhole stem may be passed up the stem by the opening and closing of the hydraulic valve assembly 312. The assembly includes the valve head 330, the valve stem 332, closure spring 334, valve seat 336, valve body collar 338, and valve lower inlet opening 340.

Once a testing or sampling is taken, the drilling operators may close the hydraulic valve by releasing the hydraulic pressure in the chamber 310 by rotating the upper testing collar 213 one-quarter turn clockwise, and lowering the drill stem on the borehole bottom. The weight of the drill stem will exceed the collapse pressure of second restriction c-ring 322. The ring 322 will collapse back into position in groove 322A and the entire valve body collar 338 will move upwardly to close the valve head 330 against valve seat 336.

Turning to FIGS. 8A–18A, the operation of the testing tool 201 may be seen. To clarify the drawing the test activating tool 21 is not shown as seated in the nipple 23A, but one of ordinary skill in the art would understand the operation of the tool 201.

Figure 8A:
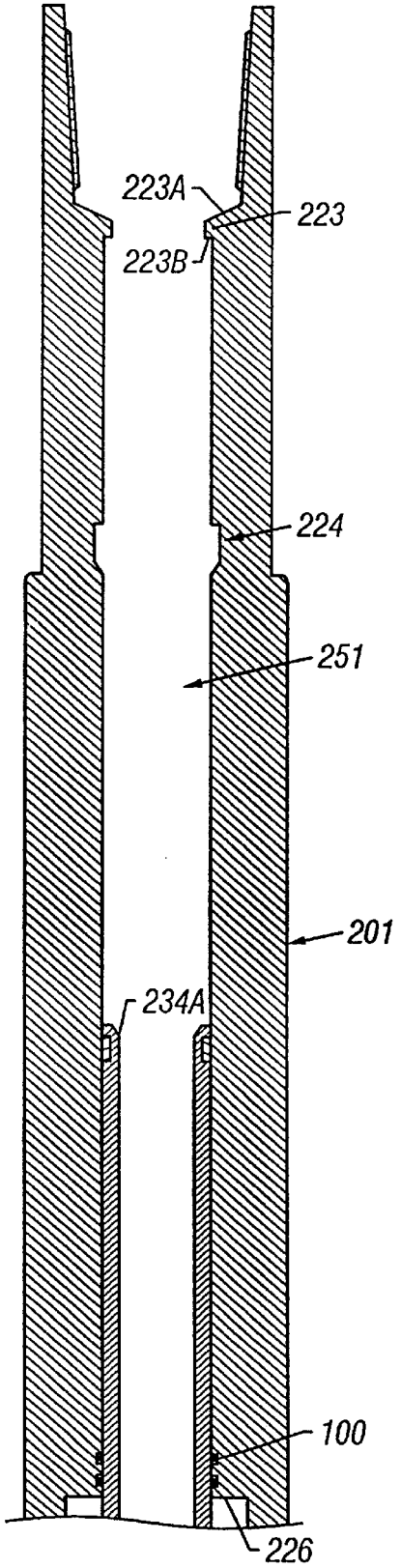
FIGS. 8–17 and 8A–17A are longitudinal cross-sectional views of the testing tool.
Figure 8:
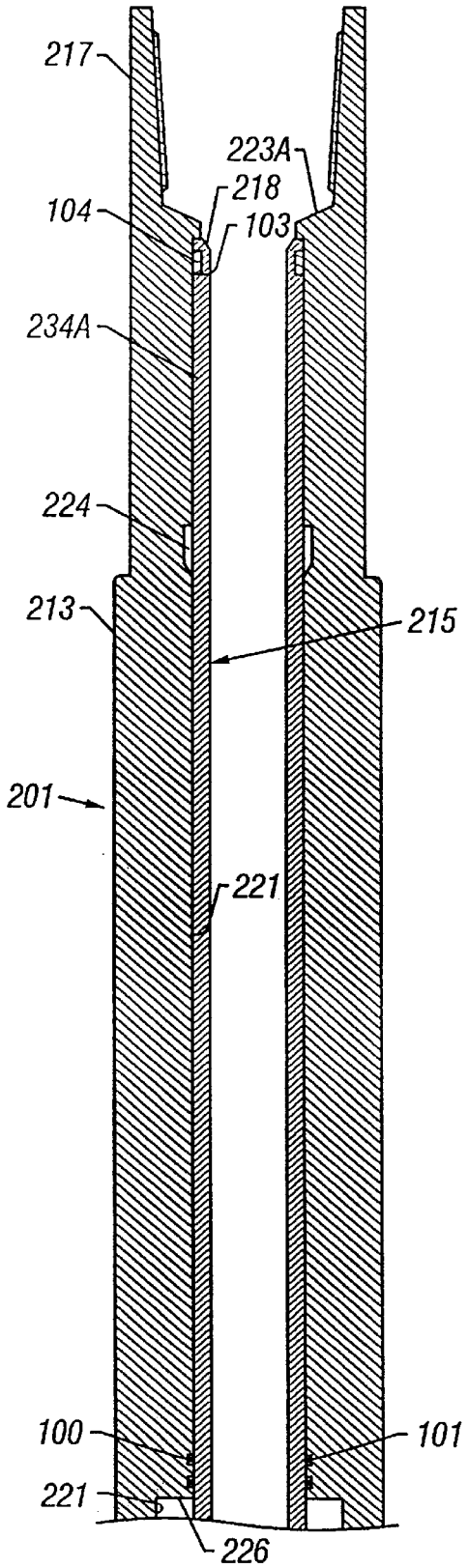
Figure 12A:
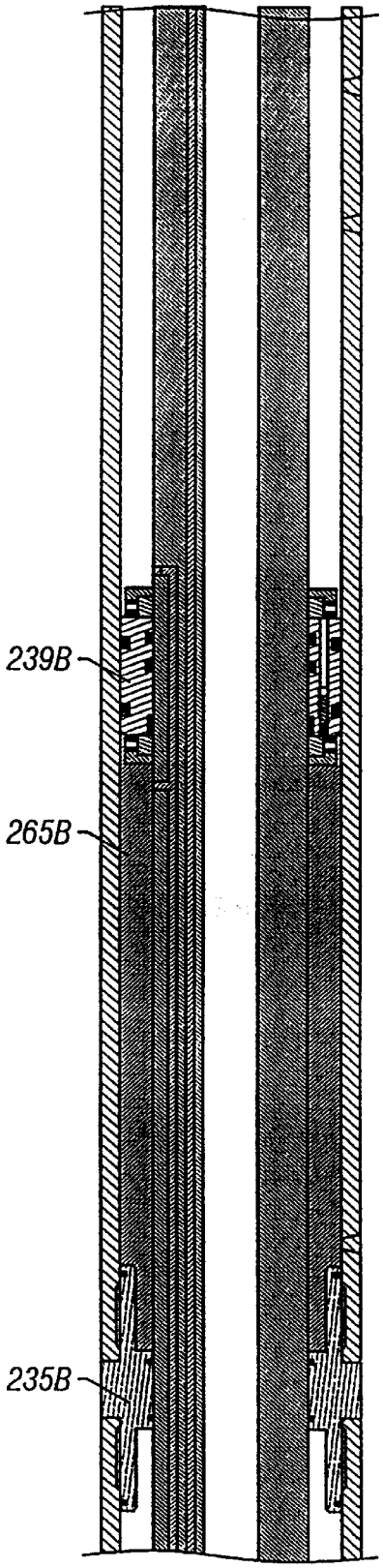
FIG. 12A is the intermediate piston and intermediate hydraulic reservoir portions of the activated tool.
Figure 12:
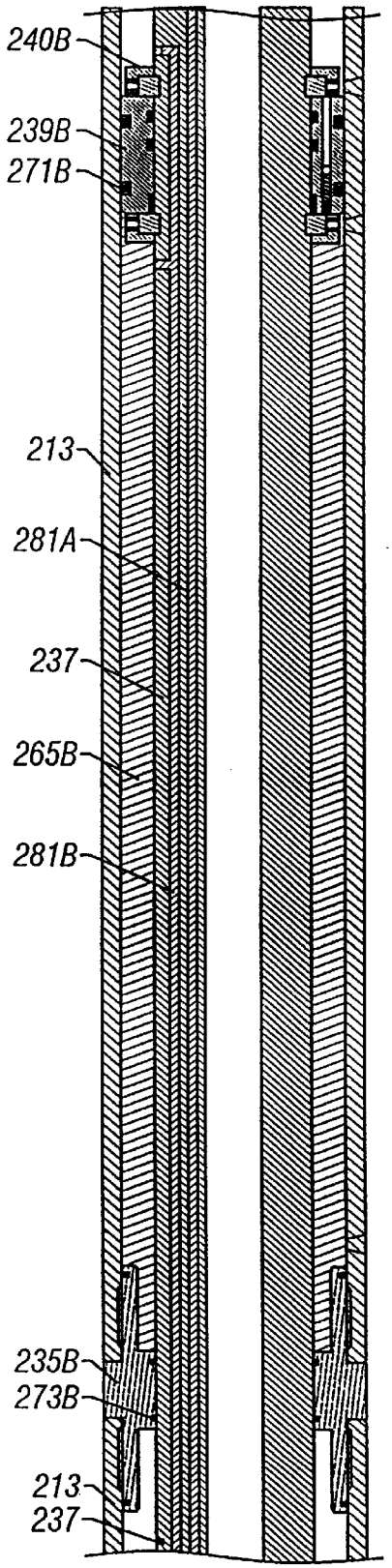

In FIG. 8A, it must be understood that the upper drilling collar 213 has been rotated one-quarter turn counterclockwise to align the collet teeth 242 with the spline teeth 231A, the test activating tool 21 (not shown) has been seated in nipple 23A, and nipple 23A has been urged downwardly compressing spring 255. The upper sleeve collar portion 216A has moved downwardly away from the collet teeth 242. Because of the resiliency of the collet 219, when the collar portion 216A is moved away from the upper end of the collet 219 and the collet is urged downwardly applying tension to spring 255 against shoulder 106, the collet head 700 collapses inwardly and teeth 242 slide off tapered shoulder 227. The collet 219 continues downwardly engaging the spline teeth 231A. Spline mandrel 236 is urged downwardly (FIGS. 9A and 10A). Packer mandrel 237 moves downwardly causing pistons 239A, 239B, and 239C to compress fluid in the associated reservoirs 265A, 265B, and 265C (see FIGS. 11A, 12A, and 13A). As the fluid is compressed, the separate packer elements 211A, 211B, and 211C are inflated (FIGS. 14A, 15A, and 16A) simultaneously, move downwardly along the borehole wall and wipe the wall surface for positive engagement and sealing of the borehole.

Compressed fluid from one of the reservoirs (in the present embodiment reservoir 265C via conduit 281C) opens the hydraulic float valve 312 to allow well fluids to enter the drilling test tool 201 for sampling.

To deactivate the drilling test tool the upper testing collar 213 is rotated one-quarter turn counterclockwise allowing the collet teeth 242 to disengage from the spline teeth 231 A. The spline mandrel 236 and the packer mandrel 237 are now urged upwardly by the downward movement of the upper collar when the tool is placed in contact with the bottom of the borehole. The spring 255 has a strength slightly greater than the collapse force necessary to release restriction c-ring 104 from groove 224. The hydraulic float valve 312 may be closed by forcing the stem against the well bore bottom.

Once the tool is deactivated, drilling can be commenced. The splines 231 and 259 are able to transmit torque forces to the drill bit at the distal end of the drilling stem.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

What is claimed is:

1. An apparatus for use in a borehole with a drill string having a drill pipe and a drill bit, comprising:

an upper sleeve and a lower sleeve telescopically coupled together, the upper and lower sleeves being structured and arranged to be connected in line with the drill string above the drill bit, with the lower sleeve being closer to the drill bit than is the upper sleeve, the upper and lower sleeves having an interior passage therethrough, the upper and lower sleeves rotating together in unison;

a valve seat located in the interior passage and coupled to the lower sleeve, the valve seat being structured and arranged to accept a valve member which, when seated in the valve seat, closes the interior passage;

a plurality of separate fluid chambers located between the upper and lower sleeves, the fluid chambers having lower end walls that are connected to the upper sleeve and having upper end walls that are connected to the lower sleeve, the lower end walls, the upper end walls, and the upper and lower sleeves sealing the fluid chamber from the interior passage, the fluid chambers having fluid therein; and a plurality of separate inflatable packers coupled to the lower sleeve, the packers having packer chambers therein, the packer chambers being in communication with respective fluid chambers.

2. The apparatus of claim 1 further comprising a latching collet having engagement teeth for positive interlocking connection to spline teeth affixed to the inner wall of said upper sleeve.

3. The application of claim 2 further comprising a valve assembly attached to the lower sleeve, said assembly further comprising:

a valve body having an interior valve passage in communication with the interior sleeve passage;

a valve seat and valve member disposed in the valve passage; and a valve fluid chamber in the valve body, the valve fluid chamber in fluid communication with one of the plurality of separate fluid chambers.

* * * * *